US008531290B2

(12) United States Patent
Ghisani

(10) Patent No.: US 8,531,290 B2
(45) Date of Patent: Sep. 10, 2013

(54) ELECTRONIC DEVICE AND PROCEDURE FOR LOCATING PIECES OF LUGGAGE GONE ASTRAY

(75) Inventor: Rolando Roberto Ghisani, Capital Federal (AR)

(73) Assignees: Nicolas Keglevich, Captial Federal (AR); Francisco Domingo Polledo, Captial Federal (AR); Rolando Roberto Ghisani, Captial Federal (AR); Luis Juan Firpo Polledo, Captial Federal (AR)

( * ) Notice: Subject to any disclaimer, the term of this patent is extended or adjusted under 35 U.S.C. 154(b) by 324 days.

(21) Appl. No.: 12/949,123

(22) Filed: Nov. 18, 2010

(65) Prior Publication Data

US 2011/0241874 A1 Oct. 6, 2011

(30) Foreign Application Priority Data

Apr. 6, 2010 (AR) ..... P100101140

(51) Int. Cl.
*G08B 1/08* (2006.01)

(52) U.S. Cl.
USPC ..... 340/539.32; 340/539.13; 340/8.1

(58) Field of Classification Search
USPC ..... 340/539.32, 539.13, 571, 572.1, 340/572.8, 8.1, 568.1; 700/226
See application file for complete search history.

(56) References Cited

U.S. PATENT DOCUMENTS

| | | | | |
|---|---|---|---|---|
| 5,576,692 | A * | 11/1996 | Tompkins et al. | 340/571 |
| 6,476,718 | B1 * | 11/2002 | Cartwright et al. | 340/572.1 |
| 6,876,326 | B2 | 4/2005 | Martorana | |
| 7,451,927 | B2 | 11/2008 | Saperstein et al. | |
| 7,656,273 | B2 * | 2/2010 | Ehrman et al. | 340/10.1 |
| 8,049,616 | B2 * | 11/2011 | Hill | 340/539.13 |
| 8,253,557 | B2 * | 8/2012 | Ani et al. | 340/539.13 |
| 2001/0048364 | A1 | 12/2001 | Kalthoff et al. | |

FOREIGN PATENT DOCUMENTS

| | | | |
|---|---|---|---|
| WO | WO 96/26614 | A1 | 8/1996 |
| WO | WO 2008/054643 | A2 | 5/2008 |

* cited by examiner

*Primary Examiner* — Toan N Pham
(74) *Attorney, Agent, or Firm* — Crowell & Moring LLP

(57) ABSTRACT

An arrangement and a method for locating pieces of luggage gone astray in a commercial air flight shipment, comprising a plurality of mobile units (11) for associating to a piece of luggage to be located if gone astray, and a set of locating units on the ground (21, 22, 23, 31, 32, 33, 34, 35), wherein each of the mobile units (11) comprise: a movement detection module (15, 16) capable of detecting a state of stillness or movement of the lost piece of luggage and capable of blocking the communications of said at least one mobile units (11) from and towards said set of locating units on the ground (21, 22, 23, 31, 32, 33, 34, 35), depending on the state of stillness or movement of the lost piece of luggage.

5 Claims, 4 Drawing Sheets

ELECTRONIC DEVICE AND PROCEDURE FOR LOCATING PIECES OF LUGGAGE GONE ASTRAY

FIELD OF THE INVENTION

The present invention is related to an arrangement for locating pieces of luggage and a procedure carried out by means of the arrangement. In particular, a highly preferred embodiment of the present invention refers to an arrangement formed by a portable electronic device for locating pieces of luggage, and a set of equipment on the ground communicating with the device and a procedure for locating the luggage lost in airports and, particularly, for locating luggage which went astray due to having been loaded in a wrong flight.

Air flight lines handle billions of bundles and pieces of luggage per year, of which around 1% go astray during its transportation, and statistics indicate that, of the latter, from 0.5 to 1% are never located. This represents a figure of hundreds of thousands of bundles and pieces of luggage that disappear each year, which not only generates uncomfortable nuisances to their owners but also cost considerable amounts of money to the air flight companies and to the related insurance companies. The problem gets worse every year due to the ever increasing number of flights and, after the unfortunate Twin Towers event in September 2001 it has become an important security issue in all the airports because the presence of a single stranded piece of luggage lacking a known owner that might claim it could become a source of a terrorist attack.

STATE OF THE ART

Several devices and methods for locating pieces of luggage and lost people are known in the art.

Document WO 2008/054643 A2 describes a method, a device and a system for locating and tracking lost articles. However, unlike the present invention, the mentioned document a) does not base the tracking of the lost luggage by means of GSM, b) does not switch on or off the mobile unit according to the state of movement of the lost piece of luggage, and c) does not use a typical GSM database for locating the lost luggage.

Document U.S. Pat. No. 7,451,927 B2 discloses a real time locating system formed by a plurality of tags and an arrangement that interrogates them. However, unlike the present invention, the mentioned document a) a) does not base the tracking of the lost luggage by means of GSM, b) does not switch on or off the mobile unit according to the state of movement of the lost piece of luggage, and c) does not use a typical GSM database for locating the lost luggage.

Document U.S. Pat. No. 6,876,326 B2 describes a high precision tracking system based on a scheme of back and forth messages that precisely calculates the time of arrival (TOA) of the locating signals. However, unlike the present invention, the mentioned document bases the locating of the lost luggage by means of the difference of reception times of pulses emitted by reference stations but a) does not base the tracking of the lost piece of luggage by means of GSM and b) does not switch on or off the mobile unit according to the state of movement of the lost piece of luggage.

Document US 2001/0048364 A1 describes a locating system including one or more target monitoring devices. However, unlike the present invention, the mentioned document a) does not base the tracking of the lost luggage by means of GSM, b) does not switch on or off the mobile unit according to the state of movement of the lost piece of luggage, and c) does not use a typical GSM database for locating the lost luggage.

Document WO 96/26614 describes a system and device for locating lost elements by means of cellular telephones. The remote device can be a cellular telephone or a pager and comprises a receiver that receives a pager signal which is independent of the cellular network. The cellular transmitter activates in response to the activation signal and supplies a signal which is received by the cellular network. The cellular signal can be used for locating the device and the cellular transmission portion is activated only when it is required in order to keep the power supply. However, although the invention of the mentioned document uses cellular phone networks for locating a lost luggage, the cellular unit is turned on and off by means of a message receiver (pager) but is not capable of discriminating the actual real time movement status of the luggage, which is a main feature for its usage in air carried luggage. Further, it does not use its own GSM network database for locating the lost luggage but, instead, uses Mobile Telephone Switching Office (MTSO) data supplied by the cellular telephone service company, which would require closing special agreements with each of the telephone service suppliers present in each airport area.

ISSUES TO BE SOLVED

Many of the known systems are, more or less, reasonably adequate for locating lost articles but none of them has been specifically designed for locating pieces of luggage carried by aircrafts and loaded in loading terminals such as the commercial airports and which go astray when being loaded by mistake in a wrong aircraft. This can be seen by the simple fact that the prior art devices have no capability of blocking anytime its own communications. This poses a risky interference issue because, given the strict actual regulations that seek for guaranteeing safety in certain areas, it is not possible to operate with cellular telephone signals when being on board on a commercial plane right after the captain starts to getting ready for taking off. An in depth analysis of the way the mentioned, and also other, prior art documents function, none of them has taken in account this point and, therefore, since they lack of any technical means of blocking the transmission/reception of the tracking equipment during those moments, they are not adequate for being used in the locating of luggage air transported in commercial aircrafts. The information related to the regulation standards for cellular telephone signaling to and from commercial airplanes is available in the internet web sites of the FCC (Federal Communication Commission 445 12$^{th}$ Street S.W. Washington D.C. 20554).

See http://www.fcc.gov/cgb/consumerfacts/spanish/celloplanes.html http://www.fcc.gov In the device of the present invention, the locating of the luggage is carried out while it is motionless and on the ground, by which, during the flight the cellular telephone mobile unit is disconnected, complying with the current standards.

BRIEF DESCRIPTION OF THE INVENTION

When the check-in is carried out, or right before it is done, the tag-like mobile device unit is placed inside or attached to the luggage or package. If the luggage does not go astray, the device can be recovered when arriving at its destination. If the luggage does not arrive to its correct destination, once the passenger claims it, from any Internet access PC a server hosting a locating program WEB page is interrogated.

Further, from the server an interrogation is generated via GSM-GPRS cellular telephone and, if the piece of luggage is not on board of a airplane that is currently moving, the device will respond with a simple message which typically contains the country code and an area number, by which it may be known the airport in which the piece of luggage is currently lying and, this allows to look for it and send it to the right airport.

The typical path of a piece of luggage determines that, with the exception of brief stops, it should keep moving during the process of check-in, its transport on the conveyor band to the in-transit warehouse, its transport to the foot of the airplane, loading into the plane's storage bin and, as soon as the plane starts its maneuvers for leaving the parking dock towards the departure runway, it keeps moving till it arrives to arrival dock in the destination airport and, during all that period, the movement sensor keeps the mobile unit's communications blocked respect of the rest of the locating system. Once the mobile unit's movement sensor detects that the luggage in which it is placed is keeping still during a determined period of time, it activates the GSM cellular telephone module, allowing it to be localized if it had gone astray. The delay assigned to the movement sensor is programmable and its value will depend on several factors detailed later. The preferred range of delay is of 10-45 minutes, more preferably 25-40 minutes.

DETAILED DESCRIPTION OF THE INVENTION

Figure 1:
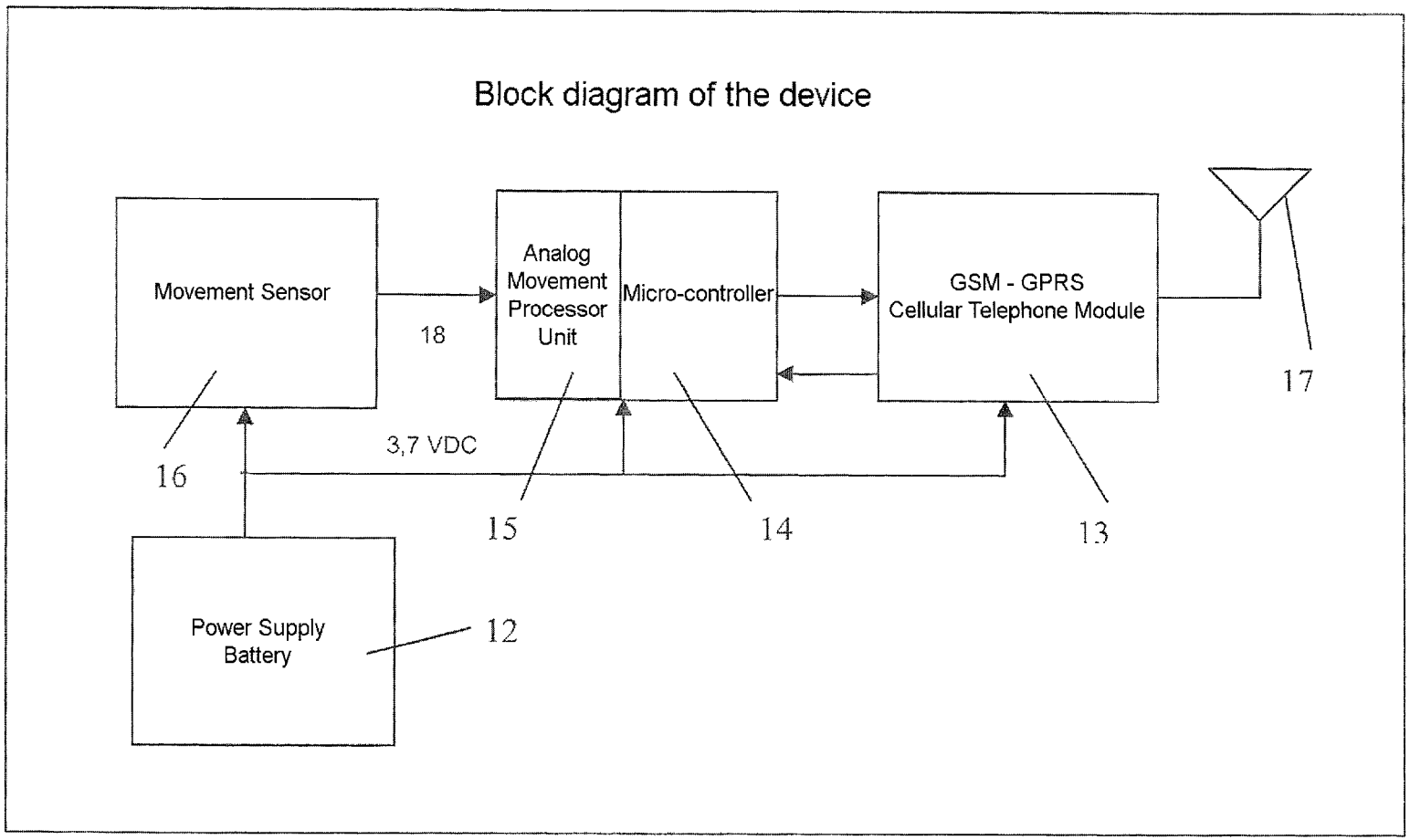
FIG. 1 shows a block diagram of the mobile unit.

FIG. 1 shows schematically the mobile unit 11 to be housed inside the piece of luggage (not shown) or attached to it as a tag. Due to mechanical safety reasons, the mobile unit is housed inside a strong and watertight housing which allows protecting the interior elements but, at the same time, with a size and weight small enough to avoid interfering with the contents of the luggage. In a preferred embodiment, the housing is made of high impact polypropylene, with a prismatic shape of around 110 mm×55 mm×1 mm. Inside the housing, a GSM-GPRS cellular telephone module 13 is placed (three or four-band), a microcontroller 14 and its associated components, a triaxial movement sensor 16 and a power supply battery 12. In a first alternative embodiment the mobile unit 11 comprises an analog unit 15 for processing the information emitted by triaxial movement sensor 16 which, in turn receives the signal 18 from the triaxial accelerometer but, in a highly more advanced preferred embodiment, the function of the processor unit 15 is carried out by the microcontroller 14 by means of additional subroutines of its software program.

Figure 2:
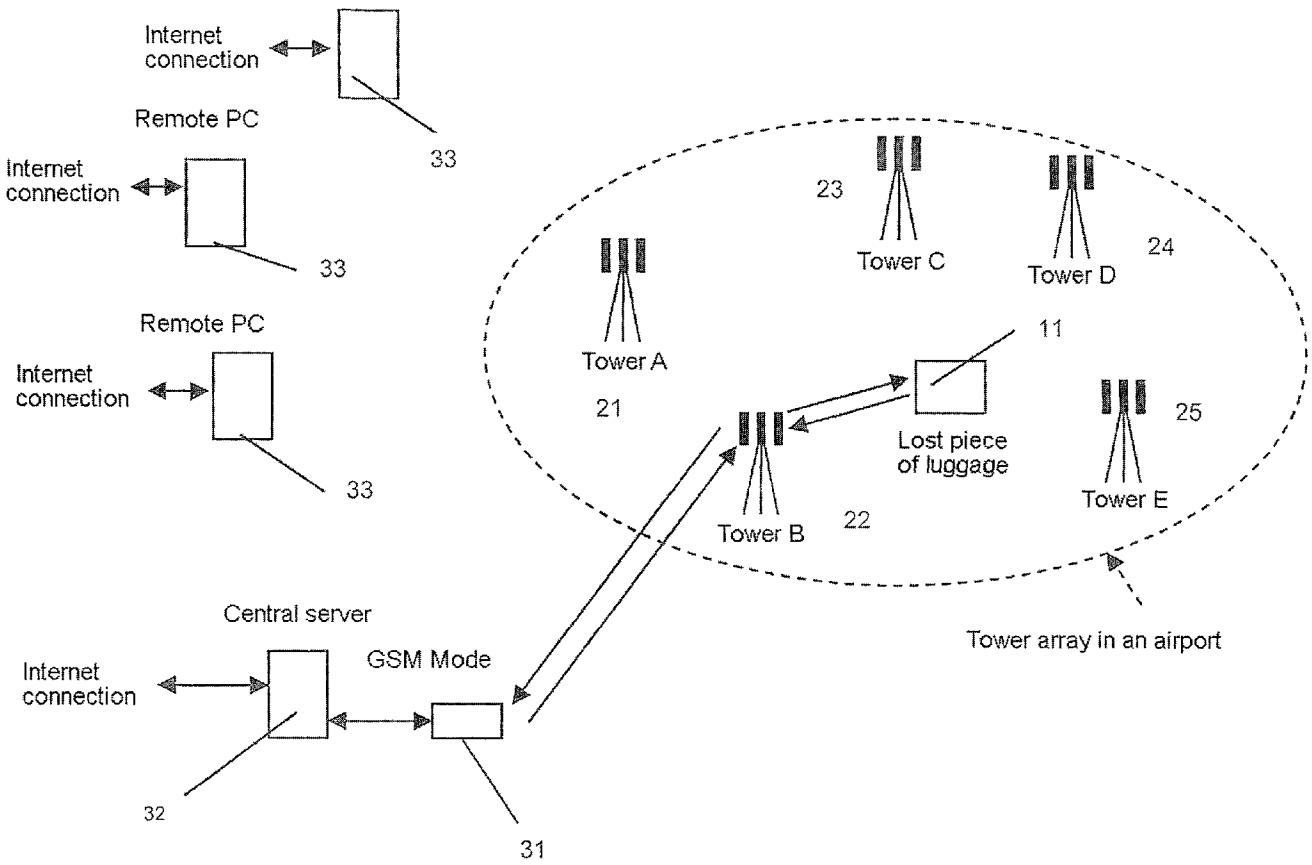
FIG. 2 presents a block diagram of the units on the ground.
Figure 3A:
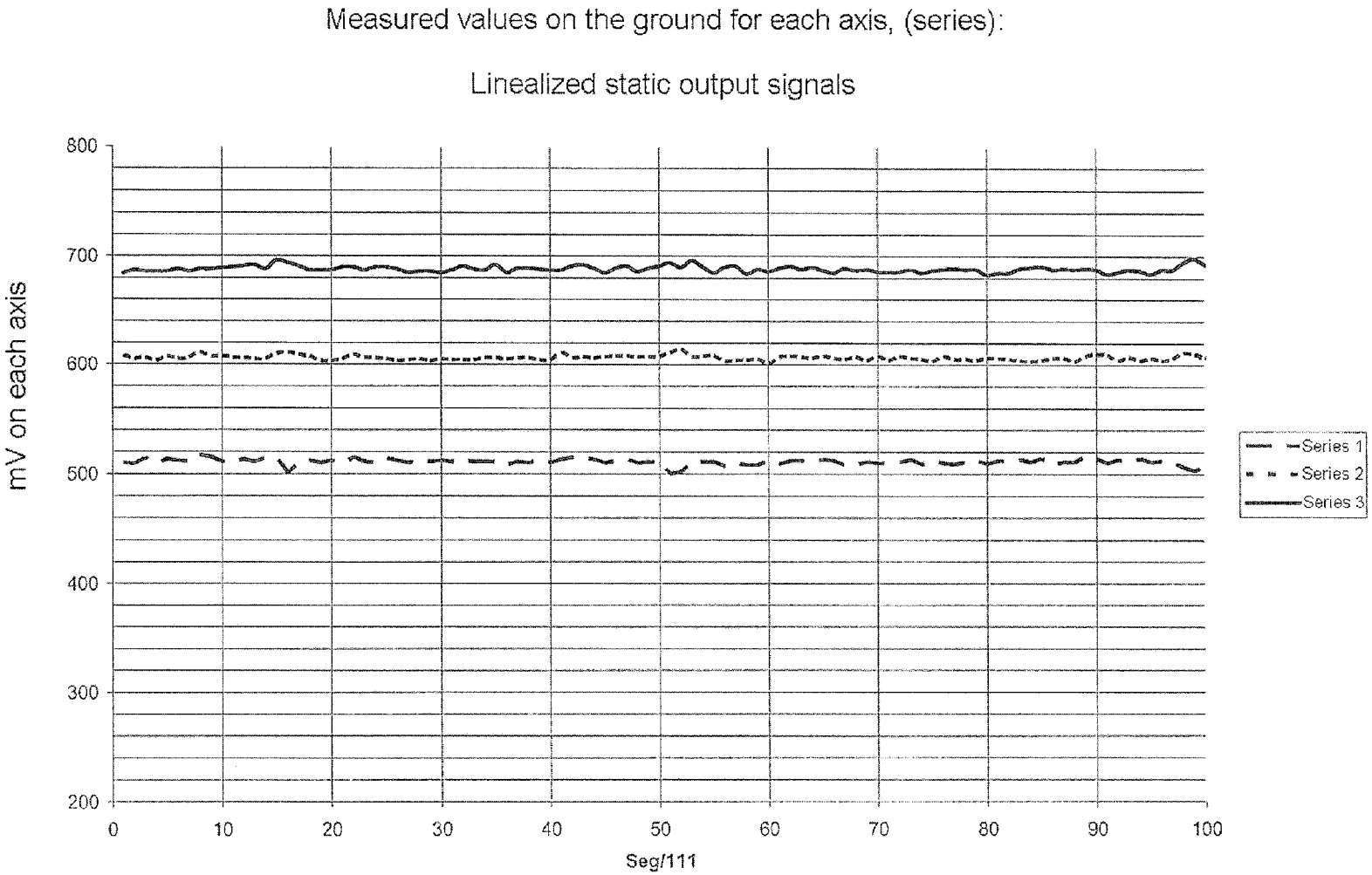
FIG. 3*a* shows signal values measured at the output of the accelerometers of each axis, with the unit being on the ground.
Figure 3B:
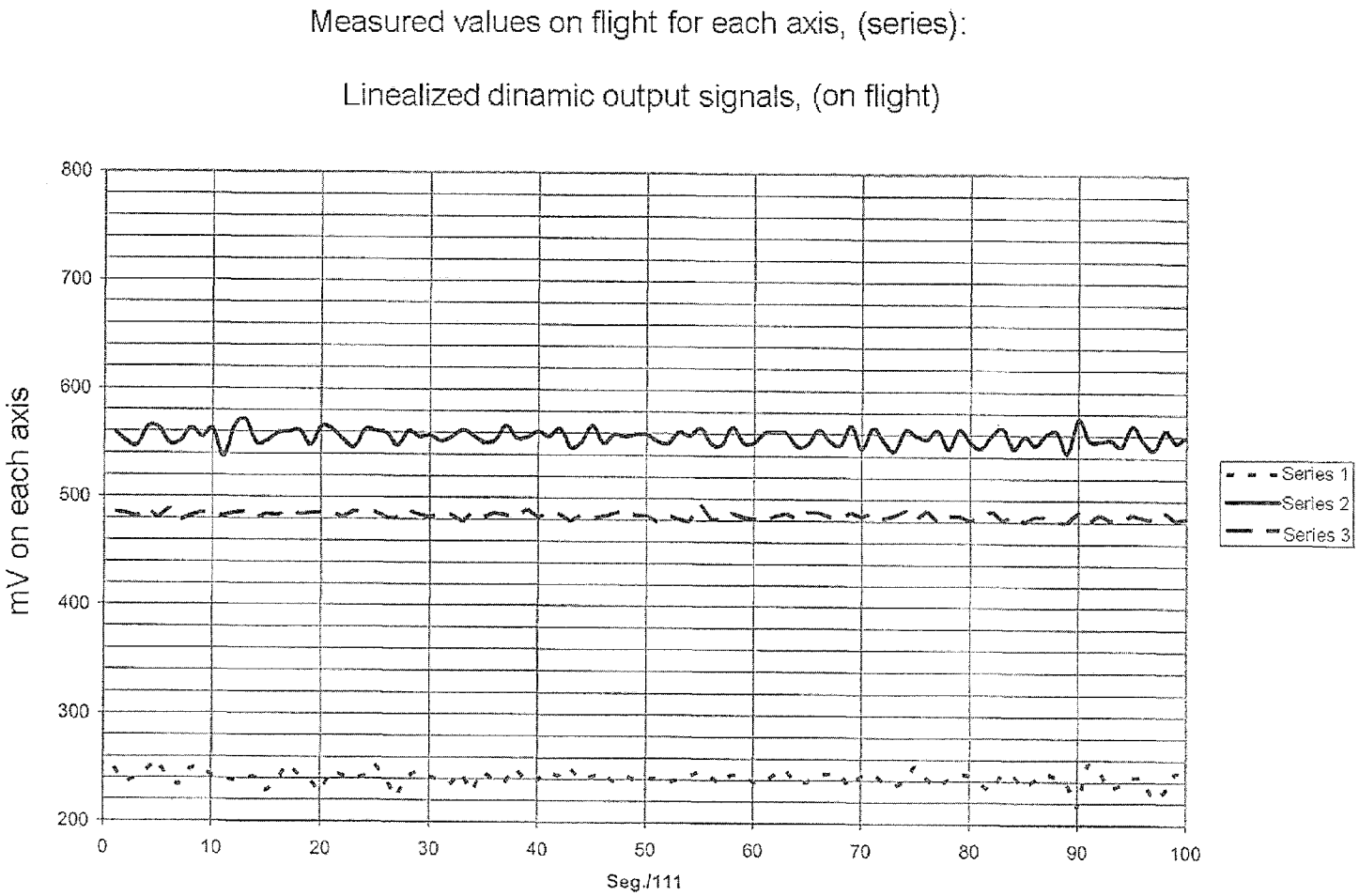
FIG. 3*b* presents signal values measured at the output of the accelerometers of each axis with the unit being in a flight.

FIG. 2 shows a block diagram of the units on the ground. In the city of the wrong arrival exist GSM "A"-"E" type cells or towers (refs. 21-25) and, since the lost luggage lies in a certain airport, the mobile unit 11 communicates with the corresponding cell, that is, with Tower "B" (ref. 22) The other components of the arrangement's unit on the ground may be geographically placed in other sites, for example, in an office foresee for such activities in any city in the world and containing: one or more servers 32 connected to the Internet via TCP/IP containing the code database for the cellular telephone towers of all the airports of interest, and in other geographical sites it may be seen one or more consultation PC's 33, for example one placed in the passenger's destination airport.

Detailed Description of the Tracking Method

The method for tracking pieces of luggage lost in a commercial air flight shipment comprises the steps of:

(i) prior to the delivery, placing in each of said pieces of luggage a mobile unit;

(ii) delivering the piece of luggage for being loaded in a commercial airplane;

(iii) if of one or more of the delivered pieces of luggage fails to arrive to its destination, sending from a remote PC (33) a telephone call to the lost luggage's mobile unit (11);

(iv) once it receives the telephone communication request, urging the mobile unit (11) to send a message containing the data identifying the place where it lies to the remote PC (33);

(v) displaying on the PC screen the data contained in the received message;

(vi) detecting the lost luggage's static or movement status and, if the piece of luggage is in movement or in a first predetermined period right after the end of a movement status, blocking the communications of steps (iii) and (iv).

A variation of the method comprises the additional steps of:

(vii) detecting again the static or movement status of the lost piece of luggage and, if the piece of luggage is still moving or in said first predetermined period right after the end of a movement status, keeping blocked the communications of steps 8iii) and (iv);

(viii) detecting the static or movement status of the lost piece of luggage and, if the piece of luggage is still or out of said first predetermined period right after the end of the movement status, unblocking the communications of steps (iii) and (iv).

The period right after a movement condition is programmable from the remote PC and is in a range of 10-45 minutes.

In a preferred embodiment the message containing the location of the piece of luggage is transmitted from the mobile unit by means of an SMS to the remote PC.

DETAILED DESCRIPTION OF THE MOBILE UNIT

In a highly preferable embodiment, the mobile unit 11 contains the modules shown in FIG. 1.

The GSM module 13 is formed by a cellular telephone transceiver with its corresponding antenna, adequate for using in GPRS.

The microcontroller unit 14 comprises an 8 bit digital microcontroller with at least three inputs with analog/digital converters and four digital outputs, one for each of the output signals of the accelerometer.

The acceleration processor unit 15 comprises a Kalman filter for estimating the trend of the series of data obtained by the microprocessor in real time, minimizing the possible errors and for determining if the device is still or under movement. As was mentioned before, in a first prototype this stage was implemented with an analog module in the commercial equipment it is carried out by means of a subroutine module in the microcontroller's software program. As may be seen in a first glance in the graphics, although the luggage's condition of being still or in movement may be determined by simple difference comparison in the AC voltage values in each axis, the usage of the filter optimizes the performance.

Accelerometer Output Comparison in Both Conditions

The triaxial accelerometer 16 comprises a capacitive triaxial accelerometer with a monopole filter for each axis with sensitivities comprised in a range of 200 to 1000 mV/g in its output signal, with a power supply of around 3 V and consuming 500 uA.

The rechargeable battery 12 is preferably a lithium-ion technology battery (50 mm×34 mm×5 or 10 mm), with weight in a range of 17 to 32 g, a capacity of 700 to 1800 mA/h, by which the total active or non-active unit consumption is less than 3 mA, and 250 mA when transmitting. Taking in account that the unit only transmits when connecting to a tower (registration), or when it is turned on, or when changing its position and being transferred from one tower connection to another (handover), or when being interrogated by the system for obtaining its location, at first its autonomy should be more than 240 hours.

The antenna 17 is preferably made of microstrip technology for a frequency band of 800-900 MHz and 1800-1900 MHz in order to being able to place it inside the housing.

Reference listing

| Ref | Element | Preferred model |
|---|---|---|
| 11 | Mobile unit | — |
| 12 | Rechargeable battery | Lithium-Ion 3.7 V 900 mA battery |
| 13 | GSM - GPRS Transceiver | Motorola ® G - 20 |
| 14 | Microcontroller | Microchip ® PIC16F777 |
| 15 | Movement processor unit | Microchip ® PIC16F777 |
| 16 | Triaxial accelerator | FREESCALE ® MMA-7261QT |
| 17 | Multiband microstrip antenna | 800-900/1800/1900 MHz |
| 21-23 | GSM cell | n/a |
| 31 | Receiver antenna | n/a |
| 32 | GSM Modem | Motorola ® G - 20 |
| 33 | Server | Dell ® PowerEdge T410 |
| 34 | Remote PC | n/a |
| 35 | Remote PC monitor | n/a |

I claim:

1. A method for locating pieces of luggage gone astray in a commercial air flight shipment, comprising: the steps of:

(i) prior to the delivery, placing in each of said pieces of luggage a mobile unit;

(ii) delivering the piece of luggage for being loaded in a commercial airplane;

(iii) if one or more of the delivered pieces of luggage fails to arrive to its destination, sending from a remote PC a telephone call to the lost luggage's mobile unit;

(iv) once it receives the telephone communication request, urging the mobile unit to send a message containing the data identifying the place where it lies to the remote PC;

(v) displaying on the PC screen the data contained in the received message; and (vi) detecting the lost luggage's static or movement status and, if the piece of luggage is in movement or in a first predetermined period right after the end of a movement status, blocking the communications of steps (iii) and (iv).

2. The method for locating pieces of luggage gone astray in a commercial air flight shipment according to claim 1, further comprising the additional steps of:

(vii) detecting again the static or movement status of the lost piece of luggage and, if the piece of luggage is still moving or in said first predetermined period right after the end of a movement status, keeping blocked the communications of steps (iii) and (iv); and (viii) detecting the static or movement status of the lost piece of luggage and, if the piece of luggage is still or out of said first predetermined period right after the end of the movement status, unblocking the communications of steps (iii) and (iv).

3. The method for locating pieces of luggage gone astray in a commercial air flight shipment according to claim 1, wherein said period after a movement condition is programmable from a remote PC.

4. The method for locating pieces of luggage gone astray in a commercial air flight shipment according to claim 1, wherein said period after a movement condition is in a range of 10-45 minutes.

5. The method for locating pieces of luggage gone astray in a commercial air flight shipment according to claim 1, wherein said message is transmitted by means of a SMS.

* * * * *